US009021982B2

(12) United States Patent
Koga et al.

(10) Patent No.: US 9,021,982 B2
(45) Date of Patent: May 5, 2015

(54) GAS WIPING DEVICE

(71) Applicant: Nisshin Steel Co., Ltd., Tokyo (JP)

(72) Inventors: Shinichi Koga, Sakai (JP); Tomohiro Fukuyama, Osaka (JP)

(73) Assignee: Nisshin Steel Co., Ltd., Tokyo (JP)

( * ) Notice: Subject to any disclaimer, the term of this patent is extended or adjusted under 35 U.S.C. 154(b) by 192 days.

(21) Appl. No.: 13/869,728

(22) Filed: Apr. 24, 2013

(65) Prior Publication Data

US 2013/0232811 A1 Sep. 12, 2013

(30) Foreign Application Priority Data

Oct. 26, 2010 (JP) ..... 2010-239831
Oct. 14, 2011 (JP) ..... 2011-226292

(51) Int. Cl.

| | |
|---|---|
| ***B05C 11/06*** | (2006.01) |
| ***F26B 15/00*** | (2006.01) |
| ***B05C 11/02*** | (2006.01) |
| ***B05C 3/12*** | (2006.01) |
| ***C23C 2/20*** | (2006.01) |
| ***C23C 2/00*** | (2006.01) |
| ***C23C 2/06*** | (2006.01) |

(52) U.S. Cl.

CPC . *F26B 15/00* (2013.01); *B05C 3/12* (2013.01); *B05C 11/06* (2013.01); *B05C 3/125* (2013.01); *C23C 2/20* (2013.01); *C23C 2/003* (2013.01); *C23C 2/06* (2013.01)

(58) Field of Classification Search

None

See application file for complete search history.

(56) References Cited

U.S. PATENT DOCUMENTS

| | | | | |
|---|---|---|---|---|
| 3,670,695 | A * | 6/1972 | Patterson | 118/63 |
| 4,321,884 | A * | 3/1982 | Barkley | 118/63 |
| 5,279,667 | A * | 1/1994 | Blankenship et al. | 118/63 |
| 8,113,139 | B2 * | 2/2012 | Kim et al. | 118/63 |

FOREIGN PATENT DOCUMENTS

| | | |
|---|---|---|
| JP | 56-166366 | 12/1981 |
| JP | 62-193671 | 8/1987 |
| JP | 62-205260 | 9/1987 |
| JP | 05-106005 | 4/1993 |
| JP | 2005-60807 A | 3/2005 |
| JP | 2005-281799 | 10/2005 |

* cited by examiner

*Primary Examiner* — Dah-Wei D Yuan
*Assistant Examiner* — Jethro M Pence
(74) *Attorney, Agent, or Firm* — Tracy M. Heims; Apex Juris, pllc.

(57) ABSTRACT

Provided is a gas wiping device having a box-shaped body which encloses a steel band and gas wiping nozzles, wherein it is possible to prevent splash on the steel band. A gas wiping device provided with a plating bath for storing molten metal, and a box-shaped body placed above the plating bath. The box-shaped body is provided, in the interior, with tubular members disposed along the width direction of a band-shaped body, gas wiping nozzles disposed facing one another on the respective tubular members so as to sandwich the band-shaped body, extending members disposed on both ends of gas wiping nozzle so as to extend towards the direction of gas wiping nozzle, and extending members disposed on both ends of gas wiping nozzle so as to extend towards the direction of gas wiping nozzle.

2 Claims, 3 Drawing Sheets

FIG. 2A
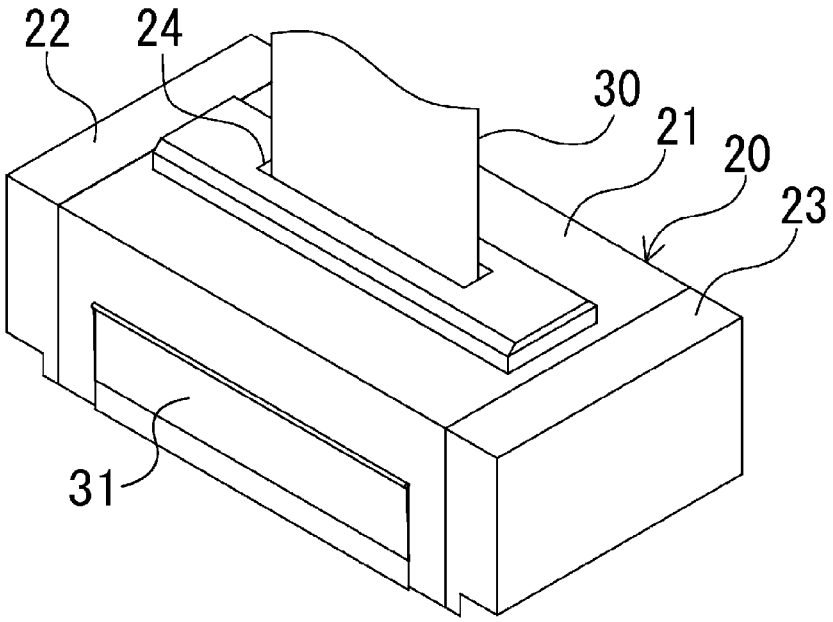
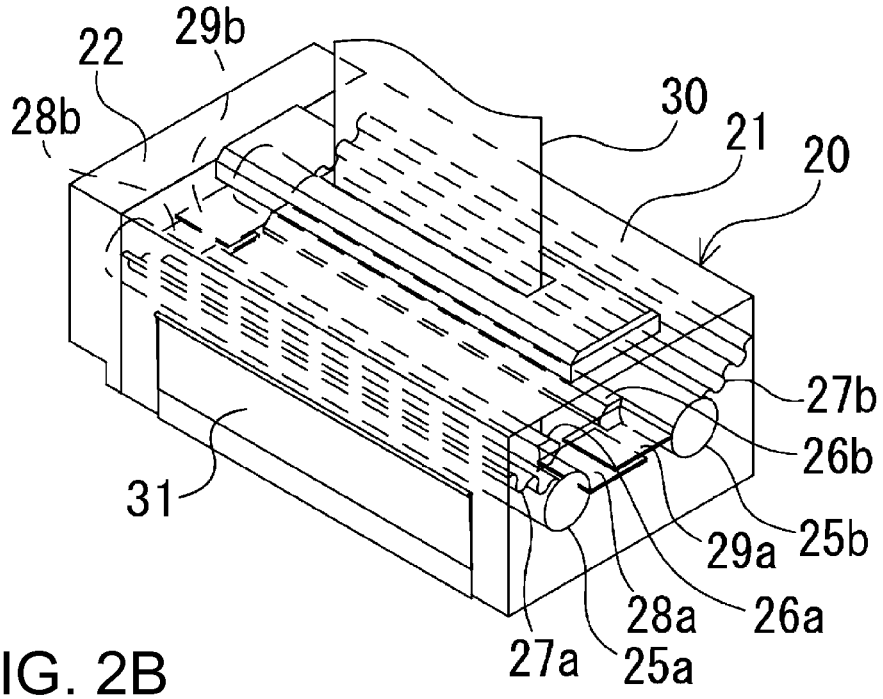
FIG. 2B

GAS WIPING DEVICE

CROSS REFERENCE TO RELATED APPLICATIONS

This is a continuation application of International Patent Application No. PCT/JP2011/073882 filed on Oct. 18, 2011 claiming priority upon Japanese Patent Application Nos. 2010-239831 and 2011-226292 filed on Oct. 26, 2010 and Oct. 14, 2011, respectively, of which full contents are incorporated herein by reference.

BACKGROUND OF THE INVENTION

1. Field of the Invention

The present invention relates to a gas wiping device configured to suppress the adhesion of splashes on a steel band.

2. Description of the Background Art

Among the gas wiping devices configured to control the thickness of plating formed on a steel band by spraying gas thereon subjected to immersion in molten metal, a device equipped with a sealed box to prevent surface roughness of the steel band has been conventionally known.

Such a type of gas wiping device has been configured to house a steel band and gas wiping nozzles to spray gas in a sealed box, and regulate the concentration of oxygen in the sealed box within a predetermined range (e.g. within 1%), thereby enabling prevention of surface roughness on the steel band. However, the gas wiping devices equipped with such sealed boxes, as compared to those without sealed boxes, have caused a notable adhesion of splashes on steel bands, which has resulted in an increase in the number of splash-induced spots.

In order to suppress the adhesion of splashes on steel bands, the gas wiping device disclosed in e.g. Patent Document 1 includes: an enclosure housing a band-shaped body (steel band) and gas wiping nozzles, and having an exit for the band-shaped body; a pair of baffle plates arranged in the enclosure so as to face each other across the band-shaped body, and further so as to contact the lower end face of at least one of the gas wiping nozzles, and still further so as to divide and partition the enclosure into upper and lower spaces while leaving an opening of the enclosure for allowing the band-shaped body to pass therethrough, where the upper space has the gas wiping nozzles arranged therein; and wiping gas outlets communicating with the lower space of the enclosure and connected to vacuum and exhaust means.

Prior Art Documents

Patent Documents

Patent Document 1: Japanese Patent Application Publication No. S62-193671

Problems to be Solved

Recently, there have been growing examples where hot-dipped Zn—Al—Mg system plated steel sheets manufactured by using a Zn-plating bath containing appropriate amounts of Al and Mg are applied to a field of industries such as building materials, civil engineering and construction, housing, electrical machinery, and the like, because such plated steel sheets are more resistant to corrosion than other Zn system plated steel sheets.

For industrially manufacturing such a hot-dipped Zn—Al—Mg system plated steel sheet, it has been requested that the obtained hot-dipped plated steel sheets excel in corrosion resistance, and band-shaped products with high corrosion resistance and good surface appearance be manufactured at a high level of productivity.

In the Zn—Al—Mg ternary equilibrium phase diagram, the ternary eutectic point at which the melting point is the lowest (melting point=343° C.) is recognized in the vicinity of 4-wt % Al and 3-wt % Mg. However, bath compositions in the vicinity of the ternary eutectic point cause a local crystallization of $Zn_{11}Mg_2$ system phase (Al/Zn/$Zn_{11}Mg_2$ ternary eutectic matrix itself; $Zn_{11}Mg_2$ system phase of Al primary crystals mixed in the matrix; and/or $Zn_{11}Mg_2$ system phase of Al primary crystals and Zn single phase mixed in the matrix) to occur in the structure of the plating layer. Such a locally crystallized $Zn_{11}Mg_2$ system phase, as compared to the $Zn_2Mg$ system phase, is more easily subjected to discoloration. After having been left for a while, the discolored parts exhibit a noticeable color tone, and significantly deteriorate the surface appearance of hot-dipped Zn—Al—Mg system plated steel sheets. In addition, when such a $Zn_{11}Mg_2$ system phase is locally crystallized, the crystallized portion corrodes predominantly. Since hot-dipped Zn—Al—Mg system plated steel sheets, as compared to other Zn system plated steel sheets, have a beautiful glossy surface appearance, even tiny spots on the surface become noticeable and greatly degrade the value of the sheets as products.

The local crystallization of the $Zn_{11}Mg_2$ system phase on hot-dipped Zn—Al—Mg system plated steel sheets can be prevented by regulating, within appropriate ranges, the temperature of the plating bath and the velocity of cooling carried out after having completed plating (e.g. Japanese Patent Application Publication No. H10-226865). However, it has been recognized by the inventors of the present invention that, even when those conditions are regulated within appropriate ranges, splashes generated by gas wiping in a sealed box adhering on the steel band while the plated metal being in an unsolidified state after gas wiping cause crystallization of the $Zn_{11}Mg_2$ system phase to occur, and generate a spotty appearance; however, splashes adhering on the steel band while the plated metal being in an unsolidified state before gas wiping do not generate any spotty appearance because the splashes are re-melted.

In order to suppress the adhesion of splashes on the steel band after gas wiping, it is necessary to prevent splashes from moving toward the passage of the steel band located above a nozzle plane (an imaginary plane connecting between the tips of the gas wiping nozzles arranged to face each other) of the gas wiping nozzles. For this purpose, it is preferable that all parts are sealed in the sealed box, except the parts between the gas wiping nozzles arranged to face each other.

However, regarding such a type of gas wiping device, the distance between the gas wiping nozzles arranged to face each other is changed for controlling the thickness of plating, and therefore, it is extremely difficult to prevent splashes at both ends in a width direction of the gas wiping nozzles from moving toward the passage of the steel band located above the nozzle plane. It is also to be noted that, in the gas wiping device in Patent Document 1, splashes move from both ends in the width direction of the gas wiping nozzles toward an area above the nozzle plane, and therefore, splashes cannot be prevented from adhering on the band-shaped body (steel band).

SUMMARY OF THE INVENTION

In view of the above, the object of the present invention is to provide a gas wiping device including a box-shaped body housing a steel band and gas wiping nozzles, which device is capable of suppressing the adhesion of splashes on the steel band subjected to gas wiping.

Means for Solving Problems (1) A gas wiping device according to the present invention includes: a first gas wiping nozzle and a second gas wiping nozzle arranged to face each other across a steel band pulled up from a molten-metal plating bath, the first and second gas wiping nozzles configured to remove excess molten metal adhering on a surface of the steel band; a first tubular member disposed along a width direction of the steel band, the first tubular member connected to the first gas wiping nozzle; a second tubular member disposed along a width direction of the steel band, the second tubular member connected to the second gas wiping nozzle; a box-shaped body housing the first and second gas wiping nozzles, and the first and second tubular members; a first partition member having one end thereof fixed to an outer wall of the first tubular member, and having the other end thereof fixed to an inner wall of the box-shaped body; and a second partition member having one end thereof fixed to an outer wall of the second tubular member, and having the other end thereof fixed to an inner wall of the box-shaped body, and the gas wiping device according to the present invention further includes: a first extended member arranged to extend from one end of the first gas wiping nozzle in a width direction thereof toward the second gas wiping nozzle; a second extended member arranged to extend from the other end of the first gas wiping nozzle in a width direction thereof toward the second gas wiping nozzle; a third extended member arranged to extend from one end of the second gas wiping nozzle in a width direction thereof toward the first gas wiping nozzle; and a fourth extended member arranged to extend from the other end of the second gas wiping nozzle in a width direction thereof toward the first gas wiping nozzle, wherein the first and third extended members are arranged so that at least respective tips thereof overlap each other in a vertical direction of the device, and the second and fourth extended members are arranged so that at least respective tips thereof overlap each other in a vertical direction of the device.

According to the gas wiping device having the structures of (1) above, the first partition member seals a gap between an outer wall of the first tubular member and an inner wall of the box-shaped body, and the second partition member seals a gap between an outer wall of the second tubular member and an inner wall of the box-shaped body. In other words, the device can prevent splashes from passing through a gap between the first tubular member and an inner wall of the box-shaped body or a gap between the second tubular and the inner wall of the box-shaped body toward the passage of the steel band located above the nozzle plane connecting in an imaginary fashion between the tip of the first gas wiping nozzle and the tip of the second gas wiping nozzle. Furthermore, the device can prevent splashes from passing through a gap between the first and second gas wiping nozzles at both ends in the width direction of the gas wiping nozzles 26*a* and 26*b* toward the passage of the steel band located above the nozzle plane. In other words, splashes generated below the nozzle plane can be prevented from leaving the areas except for the nozzle widths of the first and second gas wiping nozzles arranged to face each other toward the passage of the steel band located above the nozzle plane. Therefore, even equipped with a box-shaped body housing the first and second gas wiping nozzles, the device can reduce the adhesion of splashes on a surface of the steel band subjected to removal therefrom excess molten metal by the first and second gas wiping nozzles.

(2) For the gas wiping device having the above structures, it is preferable that at least one of the first and second gas wiping nozzles is movable relative to the other while being in parallel with the other so that a distance therebetween can be changed within a predetermined range, and that even when the distance between the first and second gas wiping nozzles is the maximum distance within the predetermined range, the tips of the first and third extended members are arranged to minimally overlap each other in a vertical direction of the device, and the tips of the second and fourth extended members are arranged to minimally overlap each other in a vertical direction of the device.

According to the gas wiping device having the structures of (2) above, even when the distance between the first and second gas wiping nozzles is the maximum distance, splashes can be prevented at both ends in the width direction of the gas wiping nozzles 26*a* and 26*b* from moving toward the passage of the steel band located above the nozzle plane. In particular, even when at least one of the first and second gas wiping nozzles is movable relative to the other while being in parallel with the other, there is no interference between the first and third extended members or between the second and fourth extended members, and therefore, a parallel movement of the first gas wiping nozzle and/or the second gas wiping nozzle relative to each other is not inhibited. As a result, it is possible to prevent splashes from moving toward the steel band located above the nozzle plane at all times, irrespective of the distance between the first and second gas wiping nozzles.

Advantageous Effects of the Invention

According to the device of the present invention used as a gas wiping device configured to control the thickness of plating formed on the steel band by spraying gas thereon subjected to immersion in molten metal, splashes can be prevented from moving to the exit side of the gas wiping nozzles, and the adhesion of splashes on the steel band subjected to gas wiping can be suppressed, which results in a great reduction of defects in the surface appearance of the steel band caused by splash adhesion. In particular, for hot-dipped Zn—Al—Mg system plated steel sheets, splashes adhere on the steel band with unsolidified plated metal subjected to gas wiping, which causes crystallization of $Zn_{11}Mg_2$ system phase leading to a spotty appearance. The gas wiping device according to the present invention can certainly reduce the occurrence of a spotty appearance as well as suppress the decrease of corrosion resistance. In hot-dipped Zn—Al—Mg system plated steel sheets, even when splashes adhere on the steel band with unsolidified plated metal before gas wiping, a spotty appearance is not generated because those splashes are re-melted. Therefore, the gas wiping device according to the present invention does not need vacuum means, exhaust means, or guide plates for gas containing splashes in the lower space located below the gas wiping nozzles, such as those described in prior art literature (Japanese Patent Application Publication S62-193671), thereby realizing a simple structure with no increase in seal gas consumption.

BRIEF DESCRIPTION OF THE DRAWINGS

For more thorough understanding of the present invention and advantages thereof, the following descriptions should be read in conjunction with the accompanying drawings, in which:

FIG. 2A is a perspective view for depicting a box-shaped body in the gas wiping device shown in FIG. 1.

FIG. 2B is a perspective view for explaining the internal structure of the box-shaped body shown in FIG. 2A.

DESCRIPTION OF EMBODIMENTS OF THE INVENTION

Hereinafter, a gas wiping device as an embodiment of the present invention will be described with reference to the drawings.

Figure 1:
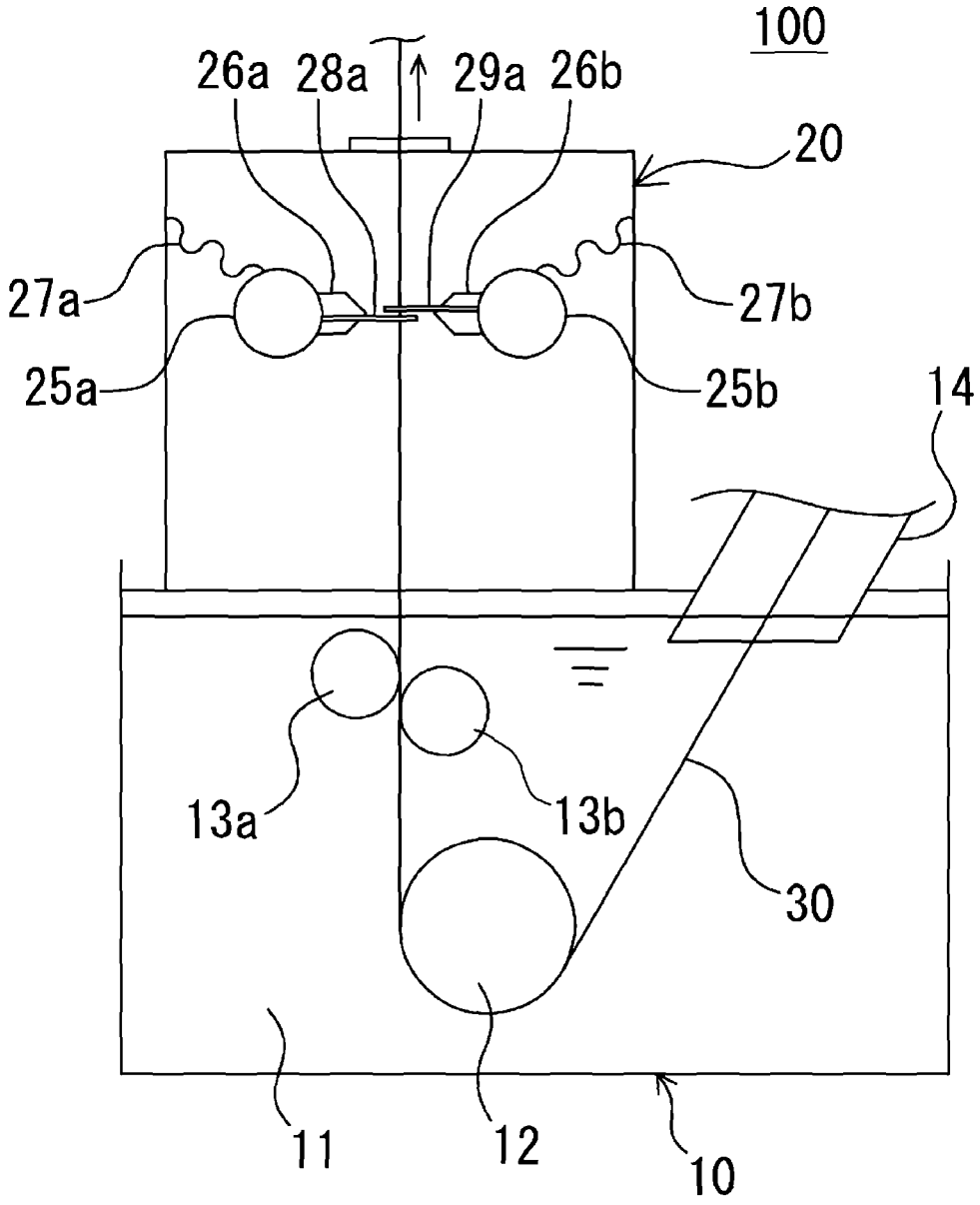
FIG. 1 is a schematic diagram of a gas wiping device as an embodiment of the present invention.

As shown in FIG. 1, a gas wiping device 100 as an embodiment of the present invention is installed on a plating bath 10 having molten metal 11 stored therein, and has a box-shaped body 20 disposed on top of the plating bath 10.

Inside the plating bath 10, there are disposed: a main-roller 12 and sub-rollers 13*a*, 13*b* for drawing and supporting a steel band 30 upward from the plating bath 10; and an inlet 14 for conveying the steel band 30 from the outside (e.g. a furnace) into the plating bath 10.

As shown in FIG. 2A, the box-shaped body 20 includes: a main body 21 having substantially a tubular shape; end caps 22, 23 for closing both ends in a width direction of the main body 21; and an outlet 24 for sending the steel band 30 plated with molten metal from the inside thereof to the outside thereof. The box-shaped body 20 is equipped with a sealing curtain 31 that is closed to ensure hermeticity during manufacturing of plated steel bands and opened at the time of discharging of dross in such a sealed box.

Furthermore, as shown in FIGS. 1 and 2B, the gas wiping device 100 includes inside the box-shaped body 20: tubular members 25*a*, 25*b* disposed along the width direction of the steel band 30; gas wiping nozzles (a first gas wiping nozzle 26*a* and a second gas wiping nozzle 26*b*) connected respectively to the tubular members 25*a*, 25*b* in such a fashion that the gas wiping nozzles face each other across the steel band 30; accordion curtains 27*a*, 27*b* having their respective first ends fixed respectively to outer walls of the tubular members 25*a*, 25*b*, and having their respective second ends fixed respectively to inner walls of the box-shaped body 20; extended members (a first extended member 28*a* and a second extended member 28*b*) arranged respectively to extend from both ends of the gas wiping nozzle 26*a* toward the gas wiping nozzle 26*b*; and extended members (a third extended member 29*a* and a fourth extended member 29*b*) arranged respectively to extend from both ends of the gas wiping nozzle 26*b* toward the gas wiping nozzle 26*a*.

The tubular members 25*a*, 25*b* are connected to a gas pipe (not shown) for sending gas from the outside of the tubular members 25*a*, 25*b* into the inside thereof. The end caps 22, 23 have an accordion structure in such a fashion that the gas pipe is movable in a longitudinal and lateral direction in FIG. 3.

The gas wiping nozzle 26*a*, which communicates with the inside of the tubular member 25*a*, is configured such that gas sent from an exterior into the tubular member 25*a* through the above-mentioned gas pipe (not shown) is sprayed from the tip of the gas wiping nozzle 26*a* toward the surface of the steel band 30. In a similar fashion, the tubular member 25*b*, which communicates with the inside of the gas wiping nozzle 26*b*, is configured such that gas sent from an exterior into the tubular member 25*b* through the above-mentioned gas pipe (not shown) is sprayed from the tip of the gas wiping nozzle 26*b* toward the surface of the steel band 30.

Figure 3:
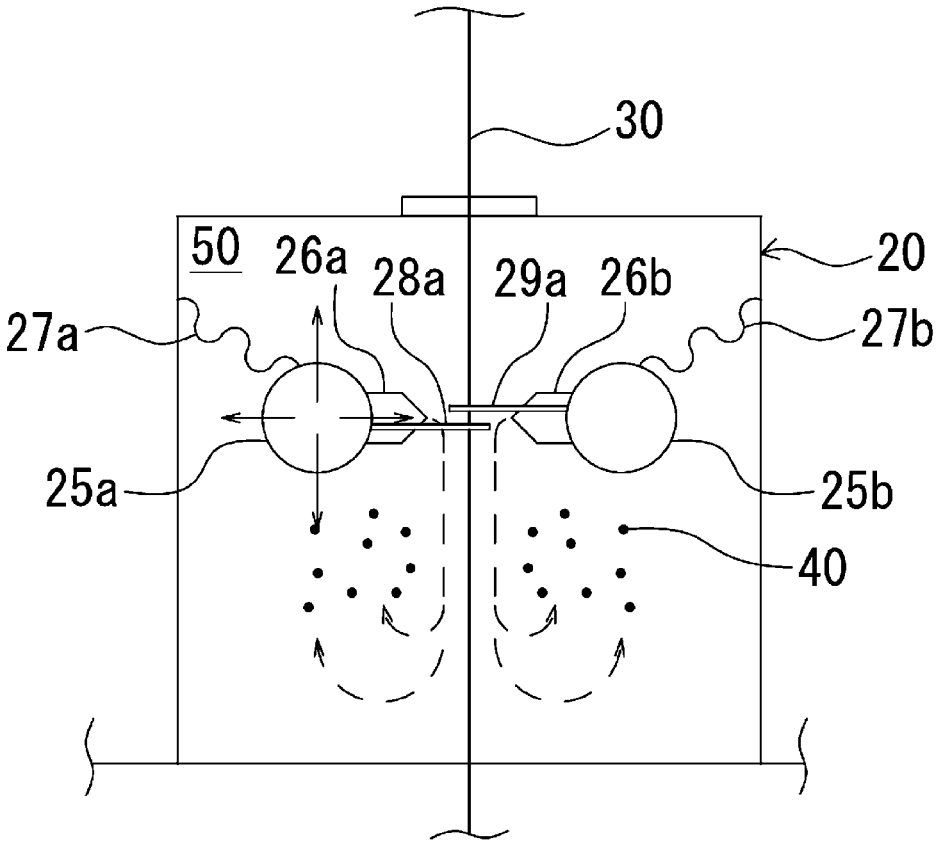
FIG. 3 is an enlarged view of the box-shaped body in the gas wiping device shown in FIG. 1.

As shown by arrows around the tubular member 25*a* in FIG. 3, the tubular member 25*a* is configured such that it is movable in a longitudinal and lateral direction in FIG. 3, and that, for example, the gas wiping nozzle 26*a* is allowed to move while maintained substantially in parallel with the gas wiping nozzle 26*b*. A distance between the gas wiping nozzle 26*a* and the gas wiping nozzle 26*b* is adjusted as one of the ways to control the thickness of molten metal plating formed on the steel band 30. In a similar fashion (not shown) to that of the tubular member 25*a*, the tubular member 25*b* is also configured such that it is movable in a longitudinal and lateral direction in FIG. 3. The distance between the gas wiping nozzle 26*a* and the gas wiping nozzle 26*b* can be changed within a predetermined range by moving one or both of the gas wiping nozzles 26*a*, 26*b* in a lateral direction in FIG. 3.

The accordion curtains 27*a*, 27*b* each serving as a partition member is made of elastic heat-resistant material, that may be either metallic member or non-woven cloth like member. By such accordion curtains 27*a*, 27*b*, a gap between the tubular member 25*a* and the inner wall (an inner wall closer to the tubular member 25*a*) of the box-shaped body 20, and a gap between the tubular member 25*b* and the inner wall (an inner wall closer to the tubular member 25*b*) of the box-shaped body 20 can be sealed, respectively. As an alternative to such an accordion curtain, another partition member may be partition plates having one fixed to the outer wall of the tubular member 25 and the other fixed to the inner wall of the box-shaped body 20, which are arranged to overlap each other in a vertical direction.

The extended members 28*a*, 28*b*, 29*a*, 29*b* are heat-resistant plate-like members each having one end connected securely to the tubular member as shown in FIGS. 1-3.

The first extended member 28*a* extending from one end in the width direction of the gas wiping nozzle 26*a* toward the gas wiping nozzle 26*b* and the third extended member 29*a* extending from one end in the width direction of the gas wiping nozzle 26*b* toward the gas wiping nozzle 26*a* are arranged to face each other while separated by a vertical gap therebetween. As mentioned above, the distance between the gas wiping nozzles 26*a*, 26*b* is variable, but even when such a distance is the maximum distance, the first extended member 28*a* and the third extended member 29*a* are arranged so that the tips thereof overlap each other. As a result, even when the distance between the gas wiping nozzles 26*a*, 26*b* is shortened, the first extended member 28*a* and the third extended member 29*a* can provide the distance with continuous sealing at one end in the width direction of the gas wiping nozzles 26*a*, 26*b* without any interference between the extended members.

In a similar way, the second extended member 28*b* extending from the other end in the width direction of the gas wiping nozzle 26*a* toward the gas wiping nozzle 26*b* and the fourth extended member 29*b* extending from the other end in the width direction of the gas wiping nozzle 26*b* toward the gas wiping nozzle 26*a* are arranged to face each other while separated by a vertical gap therebetween. As mentioned above, the distance between the gas wiping nozzles 26*a*, 26*b* is variable, but even when such a distance is the maximum distance, the second extended member 28*b* and the fourth extended member 29*b* are arranged so that the tips thereof overlap each other. As a result, even when the distance between the gas wiping nozzles 26*a*, 26*b* is shortened, the second extended member 28*b* and the fourth extended member 29*b* can provide the distance with continuous sealing at the other end in the width direction of the gas wiping nozzles 26*a*, 26*b* without any interference between these extended members.

It is preferable that the extended members 28, 29 are disposed at a height that varies within ±50 mm of the center of the nozzle aperture of the gas wiping nozzle 26*a*. The upper limit position is set at "a height of the nozzle aperture+50 mm" because a height higher than such an upper limit makes it difficult to prevent the adhesion of splashes generated by gas wiping on the surface of the steel band after gas wiping. The lower limit position is set at "a height of the nozzle aperture−50 mm" because a height lower than such a lower limit makes it difficult to prevent the adhesion of splashes on the surface of the steel band after gas wiping, and also because the height causes splashes flying away from the edges of the steel band to adhere on the extended members 28, 29, and solidify and grow thereon, thereby causing the splashes to contact a steel sheet or provoking a malfunction due to the interference between the extended members. It is also preferable that a gap between the extended members 28, 29 is set as small as possible. In addition, the tip(s) of the first extended members 28*a* and/or the second extended member 28*b* closer to the gas wiping nozzle 26*b*, and the tip(s) of the third extended member 29*a* and/or the fourth extended member 29*b* closer to the gas wiping nozzle 26*a* may have a taper shape gradually thinning rightward or leftward in FIG. 3.

Next, the operation of the gas wiping device 100 will be described. As shown in FIG. 1, the steel band 30 is conveyed from the outside through an inlet 14 into the plating bath 10 to be immersed in molten metal 11 in the plating bath 10. Subsequently, the steel band 30 is sent through the main-roller 12 and sub-rollers 13*a*, 13*b* into the box-shaped body 20. The steel band 30 conveyed into the box-shaped body 20 is allowed to pass through between the gas wiping nozzles 26*a*, 26*b*, and is sent from the outlet 24 (see FIG. 2A) to the outside of the box-shaped body 20. When passing between the gas wiping nozzles 26*a*, 26*b*, gas is sprayed to the steel band 30 from the gas wiping nozzles 26*a*, 26*b* via the tubular members 25*a*, 25*b* in order to remove excess molten metal 11 adhering on the surface of the steel band 30, thereby adjusting the thickness of the plated layer of molten metal 11 to reach the intended thickness. As shown in FIG. 3, such an operation generates splashes 40 flying around in the box-shaped body 20 (more specifically, below the nozzle plane). Therefore, the splashes must be prevented from moving toward the passage of the steel band 30 located above the nozzle plane.

However, as mentioned above, the gas wiping nozzles 26*a*, 26*b* moving in a longitudinal and lateral direction in FIG. 3, which makes it difficult to seal a gap between the gas wiping nozzles 26*a*, 26*b* at both ends in the width direction of the gas wiping nozzles 26*a*, 26*b*. In this regard, the gas wiping device in this embodiment, as mentioned above, has the first and third extended members 28*a*, 29*a* for sealing the gap at one end of the gas wiping nozzles 26*a*, 26*b*, and the second and fourth extended members 28*b*, 29*b* for sealing the gap at the other end of the gas wiping nozzles 26*a*, 26*b*, thereby enabling to suppress splashes 40 at both ends of the gas wiping nozzles 26*a*, 26*b* from flying away, and consequently making their way toward the upper space 50 in the box-shaped body 20.

In particular, in the gas wiping device 100 in this embodiment, irrespective of any distance between the gas wiping nozzles 26*a*, 26*b* (maximum or minimum), the first and third extended members 28*a*, 29*a* overlap each other, and simultaneously the second and fourth extended members 28*b*, 29*b* overlap each other, without any interference between the first and third extended members 28*a*, 29*a* or between the second and fourth extended members 28*b*, 29*b*, and thus without any obstruction to a parallel shift of the gas wiping nozzle 26*a* and/or the gas wiping nozzle 26*b*. In other words, there is continuous sealing at both ends in the width direction of the gas wiping nozzles 26*a*, 26*b* irrespective of the distance between the gas wiping nozzles, thereby preventing splashes generated below the nozzle plane from moving toward the passage of the steel band 30 located above the nozzle plane.

In addition, the accordion curtains 27*a*, 27*b* close a gap between the tubular member 25*a* and the inner wall of the box-shaped body 20 (the inner wall closer to the tubular member 25*a*), and a gap between the tubular member 25*b* and the inner wall of the box-shaped body 20 (the inner wall closer to the tubular member 25*b*), thereby preventing splashes 40 from flying away to the upper space 50 of the box-shaped body 20. As a result, splashes generated below the nozzle plane are prevented from moving toward the passage of the steel band 30 located above the nozzle plane. In view of the prevention of splashes, it is preferable that the accordion curtains 27*a*, 27*b* cover their whole respective areas in the width direction of the box-shaped body 20 (i.e. the width direction of the steel band 30).

Furthermore, since the gas (e.g. nitrogen gas) is sprayed between the gas wiping nozzles 26*a*, 26*b*, splashes generated below the nozzle plane can be prevented from moving toward the passage of the steel band 30 located above the nozzle plane.

EXAMPLES

Hot-dipped-Zn 6-mass %-Al 2.9-mass %-Mg system plated steel sheets were manufactured by using the gas wiping device shown in FIG. 2B. As a comparative example, hot-dipped-Zn 6-mass %-Al 2.9-mass %-Mg system plated steel sheets were manufactured by using a gas wiping device obtained by removing the extended members 28, 29 from the gas wiping device shown in FIG. 2B. Table 1 shows the ratio of the number of spots generated by crystallization of the $Zn_{11}Mg_2$ system phase per unit area on the plated steel sheets manufactured under the conditions that the ratio of the number of spots generated in the comparative example is set at 1. The results show that the gas wiping device according to the present invention can greatly reduce the occurrence of a splash-induced spotty appearance.

TABLE 1

| | Present invention | Comparative example |
|---|---|---|
| Generated spot number ratio | 0.5 | 1 |

As described above, the gas wiping device 100 in this embodiment has the curtains sealing a gap between the tubular member 25*a* and the inner wall of the box-shaped body 20 (closer to the tubular member 25*a*), and a gap between the tubular member 25*b* and the inner wall of the box-shaped body 20 (closer to the tubular member 25*b*), thereby preventing splashes from moving through the gaps toward the passage of the steel band 30 located above the nozzle plane. The device also prevents splashes at both ends in the width direction of the gas wiping nozzles 26*a*, 26*b* from moving between the gas wiping nozzles toward the passage of the steel band 30 located above the nozzle plane. As a result, splashes generated below the nozzle plane are prevented in all areas except for the nozzle widths of the gas wiping nozzles 26*a*, 26*b* arranged to face each other, from moving toward the passage of a steel band 30 located above the nozzle plane. Therefore, even equipped with a box-shaped body 20 housing the gas wiping nozzles 26*a*, 26*b*, the device can reduce the adhesion of splashes on the surface of the steel band 30 after excess molten metal is removed from the steel band 30 by the gas wiping nozzles 26*a*, 26*b*, thereby suppressing the increase of splash-induced spots.

In addition, the splashes can be prevented from moving toward the passage of the steel band located above the nozzle plane irrespective of the distance between the gas wiping nozzles 26*a*, 26*b*. There is no obstruction to a parallel shift of the gas wiping nozzle 26*a* and/or the gas wiping nozzle 26*b*.

Examples of Modifications

The present invention is not limited to the embodiments described above, but its scope includes various modifications allowable in accordance with the intent of the present invention. For example, the extended members 28*a*, 28*b*, 29*a*, 29*b* include plate-like members in the embodiments above, but they may be rod-like members or tubular members without being limited to the plate-like members. Such members may be in any form, as long as at least the first and third extended members are arranged so that the tips thereof overlap each other in a vertical direction of the device, and at least the second and fourth extended members are arranged so that the tips thereof overlap each other in a vertical direction of the device, thereby enabling to suppress the adhesion of splashes.

In the embodiments above, the extended members 28*a*, 28*b*, 29*a*, 29*b* are fixed respectively to the gas wiping nozzles and tubular members, but instead, they may be designed as detachable members for periodic replacement, thereby enabling easy maintenance of the gas wiping device.

In the embodiments above, the extended members 28*a*, 29*a* are arranged so that the areas in the vicinity of their respective tips overlap in a vertical direction of the device, and simultaneously the extended members 28*b*, 29*b* are arranged so that the areas in the vicinity of their respective tips overlap in a vertical direction of the device. However, their positional relationship is not limited to that shown in FIGS. 1-3, and it is acceptable, as long as at least the extended members 28*a*, 29*a* are arranged so that the tips thereof overlap each other in a vertical direction of the device, and at least the extended members 28*b*, 29*b* are arranged so that the tips thereof overlap each other in a vertical direction of the device. Needless to say, when the areas in the vicinity of the tips of the extended members 28*a*, 29*a* are arranged to sufficiently overlap in a vertical direction of the device, and the areas in the vicinity of the tips of the extended members 28*b*, 29*b* are arranged to sufficiently overlap in a vertical direction of the device, the adhesion of splashes on the steel band 30 can be more effectively inhibited. If a gap is required to be set between the extended members 28*a*, 29*a* or between the extended members 28*b*, 29*b*, for example, for ensuring good workability in maintenance of the gas wiping nozzles and/or avoiding problems such as contact caused by thermal deformation or the like, it is effective to dispose sealing material with high heat resistance at the tips of the extended members 28*a*, 29*a*, 28*b*, 29*b*.

REFERENCE NUMERALS

10 plating bath
11 molten metal
12 main-roller
13*a*, 13*b* sub-rollers
14 inlet
20 box-shaped body
21 main body
22, 23 end caps
24 outlet
25*a*, 25*b* tubular members
26*a*, 26*b* gas wiping nozzles
27*a*, 27*b* accordion curtains
28*a*, 28*b*, 29*a*, 29*b* extended members
30 steel band
31 sealing curtain
40 splashes
50 upper space
100 gas wiping device

What is claimed is:

1. A gas wiping device comprising:

a first gas wiping nozzle and a second gas wiping nozzle arranged to face each other across a steel band pulled up from a molten-metal plating bath, the first and second gas wiping nozzles configured to remove excess molten metal adhering on a surface of the steel band;

a first tubular member disposed along a width direction of the steel band, the first tubular member connected to the first gas wiping nozzle;

a second tubular member disposed along a width direction of the steel band, the second tubular member connected to the second gas wiping nozzle;

a box-shaped body housing the first and second gas wiping nozzles, and the first and second tubular members;

a first partition member having one end thereof fixed to an outer wall of the first tubular member, and having the other end thereof fixed to an inner wall of the box-shaped body;

a second partition member having one end thereof fixed to an outer wall of the second tubular member, and having the other end thereof fixed to an inner wall of the box-shaped body;

a first extended member arranged to extend from one end of the first gas wiping nozzle in a width direction thereof and toward the second gas wiping nozzle;

a second extended member arranged to extend from the other end of the first gas wiping nozzle in a width direction thereof and toward the second gas wiping nozzle;

a third extended member arranged to extend from one end of the second gas wiping nozzle in a width direction thereof and toward the first gas wiping nozzle; and a fourth extended member arranged to extend from the other end of the second gas wiping nozzle in a width direction thereof and toward the first gas wiping nozzle, wherein the first and third extended members are arranged so that at least respective tips thereof overlap each other in a vertical direction of said device, and the second and fourth extended members are arranged so that at least respective tips thereof overlap each other in a vertical direction of said device.

2. The gas wiping device according to claim 1, wherein at least one of the first and second gas wiping nozzles is configured to move relative to the other while being in parallel with the other so that a distance therebetween is configured to change within a predetermined range, and when the distance between the first and second gas wiping nozzles is the maximum distance within the predetermined range, the tips of the first and third extended members are arranged to minimally overlap each other in a vertical direction of said device, and the tips of the second and fourth extended members are arranged to minimally overlap each other in a vertical direction of said device.

* * * * *